US005991945A

United States Patent [19]

Pang

[11] Patent Number: 5,991,945

[45] **Date of Patent: *Nov. 30, 1999**

[54] DISPOSABLE PILLOW OR CUSHION COVER

[76] Inventor: Hian Seng Pang, No. 7 Watten Dr., Singapore, Singapore, 287643

[ * ] Notice: This patent is subject to a terminal disclaimer.

[21] Appl. No.: 09/042,710

[22] Filed: Mar. 17, 1998

Related U.S. Application Data

[63] Continuation of application No. 08/692,256, Aug. 5, 1996, Pat. No. 5,727,266.

[30] Foreign Application Priority Data

Jan. 4, 1996 [SG] Singapore ..... 9600028-6

[51] Int. Cl.[6] ..... A47G 9/02

[52] U.S. Cl. ..... 5/490; 5/636; 5/652.1; 5/922

[58] Field of Search ..... 5/490, 652.1, 656, 5/636, 724, 938, 655, 464

[56] References Cited

U.S. PATENT DOCUMENTS

| | | | |
|---|---|---|---|
| 1,275,205 | 8/1918 | Bigham et al. . | |
| 1,380,480 | 6/1921 | Jennings | 5/339 |
| 1,542,561 | 6/1925 | Laskin et al. . | |
| 2,234,506 | 3/1941 | Sistig | 5/327 |
| 2,357,789 | 9/1944 | Levy | 5/339 |
| 2,412,769 | 12/1946 | Easterbrooks | 5/339 |
| 2,944,266 | 7/1960 | Wertheimer | 5/341 |
| 3,042,938 | 7/1962 | Lawson | 5/337 |
| 3,216,028 | 11/1965 | Lawson | 5/337 |
| 3,840,918 | 10/1974 | Shave | 5/338 |
| 4,309,784 | 1/1982 | Cohen | 5/490 |
| 4,445,241 | 5/1984 | Ender et al. . | |
| 4,649,582 | 3/1987 | Cho | 5/434 |
| 4,914,772 | 4/1990 | Difloe | 5/490 |
| 4,959,880 | 10/1990 | Tesch | 5/434 |
| 5,038,431 | 8/1991 | Burgin et al. | 5/438 |
| 5,068,936 | 12/1991 | Blitzer | 5/490 |
| 5,144,911 | 9/1992 | Moore et al. | 5/490 |
| 5,168,590 | 12/1992 | O'Sullivan | 5/490 |
| 5,184,362 | 2/1993 | Yager et al. | 5/490 |
| 5,268,222 | 12/1993 | Honeycutt | 5/490 |
| 5,321,861 | 6/1994 | Dancey et al. | 5/490 |
| 5,375,278 | 12/1994 | VanWinkle et al. | 5/644 |
| 5,388,296 | 2/1995 | Mansour | 5/638 |
| 5,561,876 | 10/1996 | Petruzella | 5/655 |
| 5,572,753 | 11/1996 | Ruscitto | 5/490 |

OTHER PUBLICATIONS

Journal of A.M.A. (Oct. 18, 1958: vol. 108).

*Primary Examiner*—Michael F. Trettel
*Assistant Examiner*—Frederick Conley
*Attorney, Agent, or Firm*—Jacobson, Price, Holman & Stern, PLLC

[57] ABSTRACT

A disposable pillow or cushion cover is formed by an envelope of air and moisture impermeable material. The envelope encases the pillow or cushion and provides an impermeable resting surface upon which a user may rest the head or other body part on a clean, comfortable, fresh, hygienic, fragrant resting surface without having to change pillows, cushion covers or envelopes. The envelope contains a vent to permit ingress and egress of air from the pillow or cushion. The envelope also includes a sealable opening to permit insertion and removal of the pillow or cushion. A facing layer of air permeable material extends over the resting surface and is secured to the envelope at spaced apart locations to allow air flow and a degree of relative movement between the facing layer and envelope.

9 Claims, 3 Drawing Sheets

DISPOSABLE PILLOW OR CUSHION COVER

This a continuation of application Ser. No. 08/692,256 filed Aug. 5, 1996. Now U.S. Pat. No. 5,727,266.

FIELD OF THE INVENTION

This invention relates to pillows and cushions.

BACKGROUND OF THE INVENTION

Pillows and cushions are generally formed by encasing some form of filling within a sealed envelope. The filling can take many forms from non-resilient cotton waste to resilient foam rubber and a wide variety of other materials. In most cases, the envelope is formed from a cloth or similar material, and very often, a covering such as a pillow case or cushion cover is used over the cushion or pillow. These covers are also normally formed from a cloth and usually serve the dual role of being decorative and permitting laundering without the need to launder the encased pillow or cushion.

When pillows and cushions are used as a support for the head of a person, the face comes in very close contact with the outer surface. Consequently, the user breathes the air surrounding the pillow. Both the outer covering of the pillow or cushion and the pillow or cushion itself, are susceptible to contamination by saliva, perspiration and other bodily fluids of previous users. This can lead to offensive odors being inhaled by subsequent users, and in some cases, the risk of inhalation or contact with germs or viruses. Whilst the practice of changing pillow cases or cushion covers does to some extent avoid this problem, it does not adequately deal with the problem of contamination of the pillow cushion itself.

SUMMARY OF THE INVENTION

It is an object of this invention to provide a pillow or cushion cover which will overcome, or at least, ameliorate the foregoing disadvantages.

Accordingly, in one aspect, this invention consists of a disposable pillow or cushion cover comprising an envelope of air and moisture impermeable material to encase the pillow or cushion and provide an impermeable resting surface upon which a user may rest the head or other body part on a clean, comfortable, fresh, hygienic, fragrant resting surface without having to change pillows, cushion covers or envelopes. Vent means in the envelope permit ingress and egress of air from the pillow or cushion, the vent means being disposed to direct egressing air away from the resting surface. Access means in the envelope permit insertion and removal of the pillow or cushion, and a facing layer of air permeable material extending substantially over the resting surface is secured to the envelope at spaced apart locations to allow air flow and a degree of relative movement between the facing layer and the envelope.

Preferably, the access means takes the form of an overlapping flap of the envelope covering an opening in the side of the envelope opposite to the resting surface. In a preferred form, fastening means can be included to releasably secure the flap to the envelope. These can take the form of a conventionally available fastening, such as a hook and loop fastening of the kind sold under the trademark VELCRO.

In another preferred form, the flap includes means to selectively effect an air and moisture impermeable seal. This can take the form, for example of a press-to-engage type seal of the kind used on resealable plastic bags and known by the trademark MAGIC SEAL.

The vent means preferably takes the form of a series of holes in the side of the envelope opposite to the resting surface. In a preferred form, the holes are located in a central region of the opposite surface so as to be as physically removed from the resting surface as possible.

The facing layer is preferably secured to the pillow by being secured at its perimeter edges. In an alternative embodiment, the facing layer can be quilted to the surface of the envelope at spaced apart locations by gluing for example.

It will be apparent that the foregoing invention provides a conveniently disposable cover, which can be changed between users to avoid the risk of exposure to contamination of the pillow by a previous user. The cover does not interfere with the normal ingress and egress of air from the pillow, and thus, does not effect the resilient qualities of the pillow. Additionally, the facing layer provided over the resting surfaces provides a comfortable surface for the user and allows the flow of air to avoid discomfort that would be experienced if the layer contacting the user were impermeable. The disposable cover thus provides a clean surface to each new user and can, if desired be sterilized, or otherwise treated, such as by impregnation with a fragrance. A range of fragrances can be used depending upon the requirements of users. An appropriate fragrance can enhance the comfort of the user.

It is also possible to incorporate a resilient layer between the facing layer and the impermeable layer to provide additional comfort for the user. Preferably, the resilient layer is formed from foam rubber or the like and can be laminated to the impermeable layer.

BRIEF DESCRIPTION OF THE DRAWINGS

One embodiment of the invention will now be described, with references to the accompanying drawings, in which.

DETAILED DESCRIPTION OF THE PREFERRED EMBODIMENTS

Figure 1:
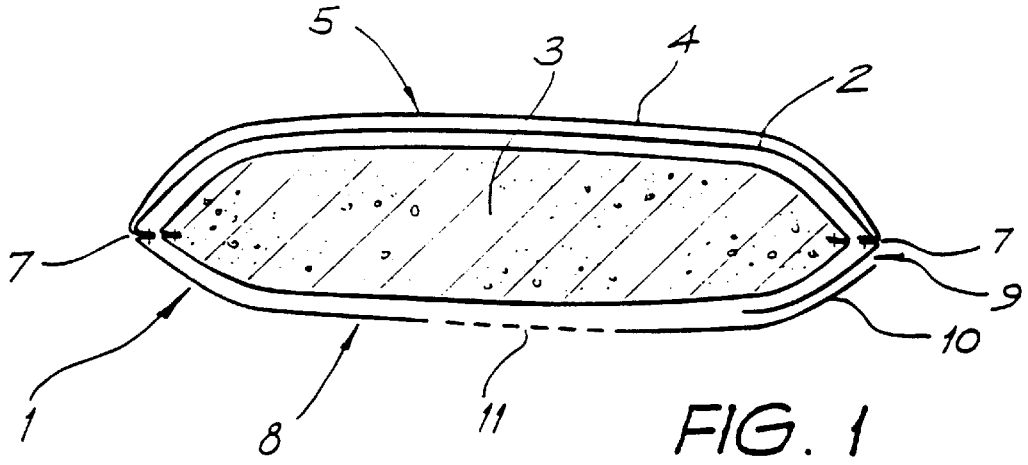
FIG. 1 is a cross sectional view of the disposable pillow or cushion cover of this invention fitted to a pillow.
Figure 2:
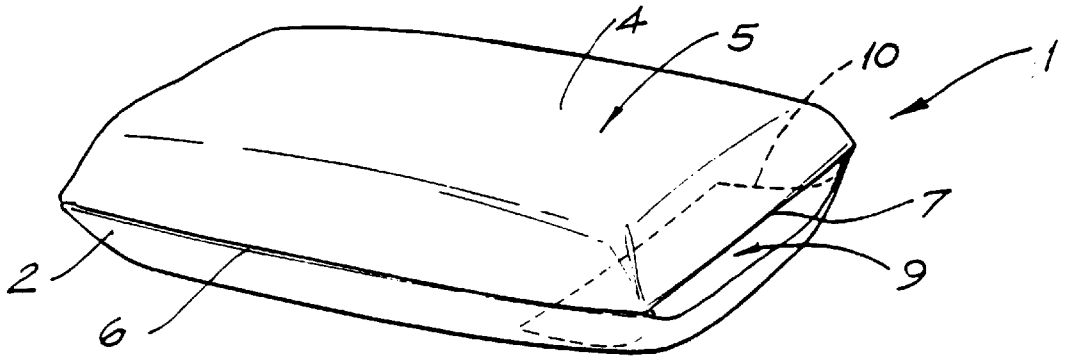
FIG. 2 is a perspective view showing the top of the cover shown in FIG. 1.
Figure 3:
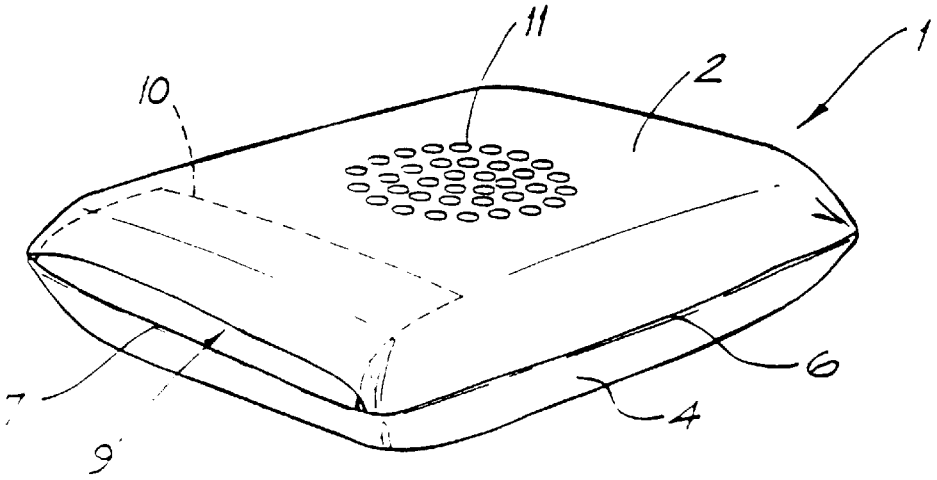
FIG. 3 is a perspective view showing the bottom of the cover shown in FIG. 1.

In FIGS. 1 to 3, the disposable pillow or cushion cover 1 of this invention is formed by an envelope of air and moisture impermeable material 2 which encases a pillow 3. The envelope 2 is formed from any suitable pliable moisture and air impermeable materials such as polyethylene or similar materials. A facing layer 4 of cloth or the like provides the upper or resting surface 5 of the cover. The facing 4 is attached to the envelope along the side seams 6 and end seams 7 of the envelope or in other words, along the perimeter of the facing layer. This allows an air flow between the envelope and the facing layer, as well as a degree of relative movement between the layers. This arrangement increases the comfort of the user by allowing air circulation to avoid excessive perspiration and movement to improve the feel of the pillow. There is however sufficient friction between the respective layers and the pillow to avoid a slippery feel to the cover.

The side 8 opposite to the resting surface 5 incorporates an opening 9 covered by a flap 10. This opening permits the insertion and removal of the pillow from the cover. The overlap of flap 10 is in the nature of the opening provided in a conventional pillow case, whereby the sides of the overlap are secured, so that the opening is normally closed, but can be manipulated to allow a pillow to be inserted and removed.

A series of holes 11 are also provided in the opposite side 8 to form a vent, which allows the egress and ingress of air from the envelope. This allows the normal movement of air in and out of the pillow during use, but directs this air away from the resting surface.

Figure 4:
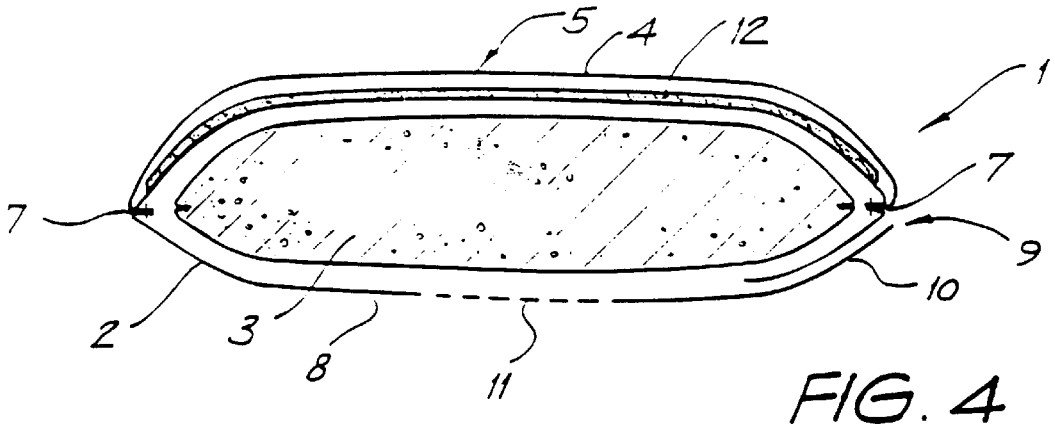
FIG. 4 is a cross sectional view similar to FIG. 1 of a modified embodiment of the cover of this invention.

FIG. 4 shows a modified embodiment of the cover which is identical to the first embodiment described above except for the inclusion of a layer of resilient material 12 between facing layer 4 and envelope 2. The layer is preferably bonded to the envelope material, which reinforces the insulating layer and is provided to improve the comfort to the user.

Figure 5:
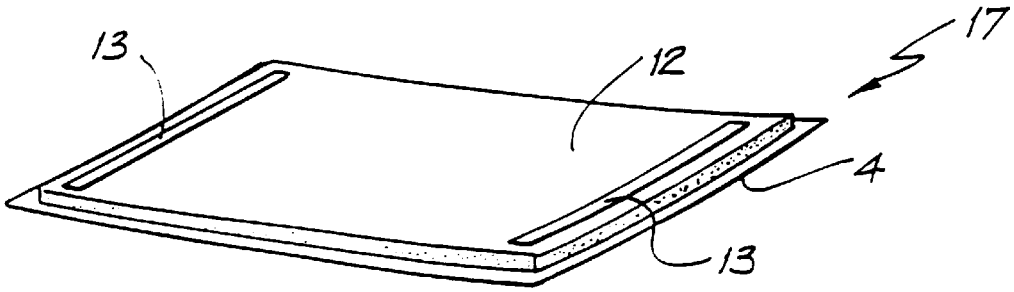
FIG. 5 is a perspective view showing part of a further embodiment of the pillow or cushion cover of this invention.
Figure 6:
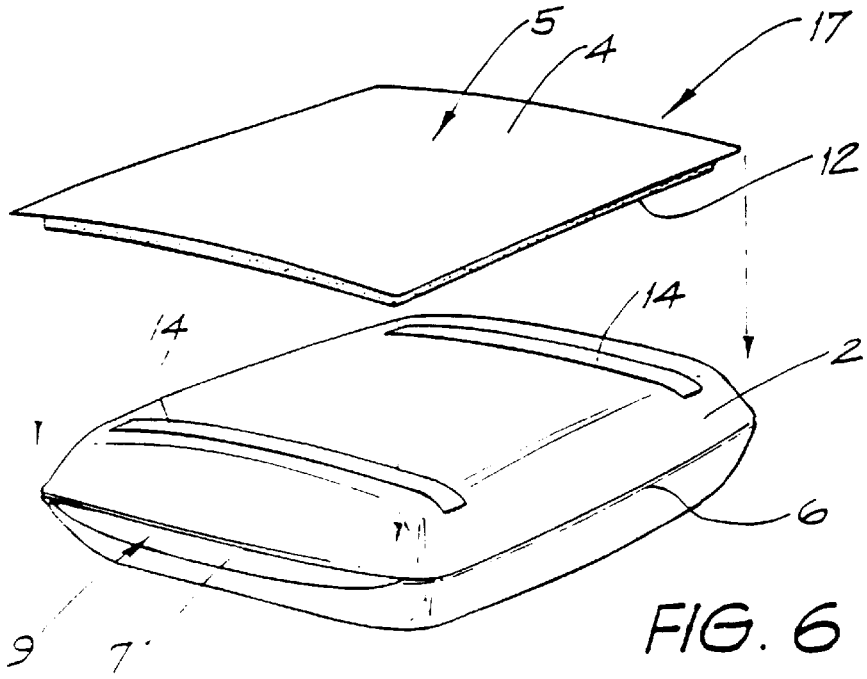
FIG. 6 is a perspective view showing the part of FIG. 5 and the remainder of the cover of the further embodiment.

FIGS. 5 and 6 show a further embodiment of a cover of this invention. Where applicable like reference numerals have been used to indicate corresponding features to the embodiments described above. In the embodiment of FIGS. 5 and 6, the resilient layer 12 is secured to the facing layer 4 to form a composite element 17. This can be achieved by attaching the layers along their perimeters for example, or by any other suitable method. The underside of resilient layer 12 is provided with two strips of adhesive material 13 along opposed edges. Corresponding lines of adhesive material 14 are provided on the envelope 2. This allows the composite 17 formed by resilient layer 12 and facing layer 4 to be releasably secured to the envelope 2. The composite 17 can thus be removed from the envelope 2 and replaced with a fresh composite. This allows the envelope 2 to be re-used a number of times.

Figure 7:
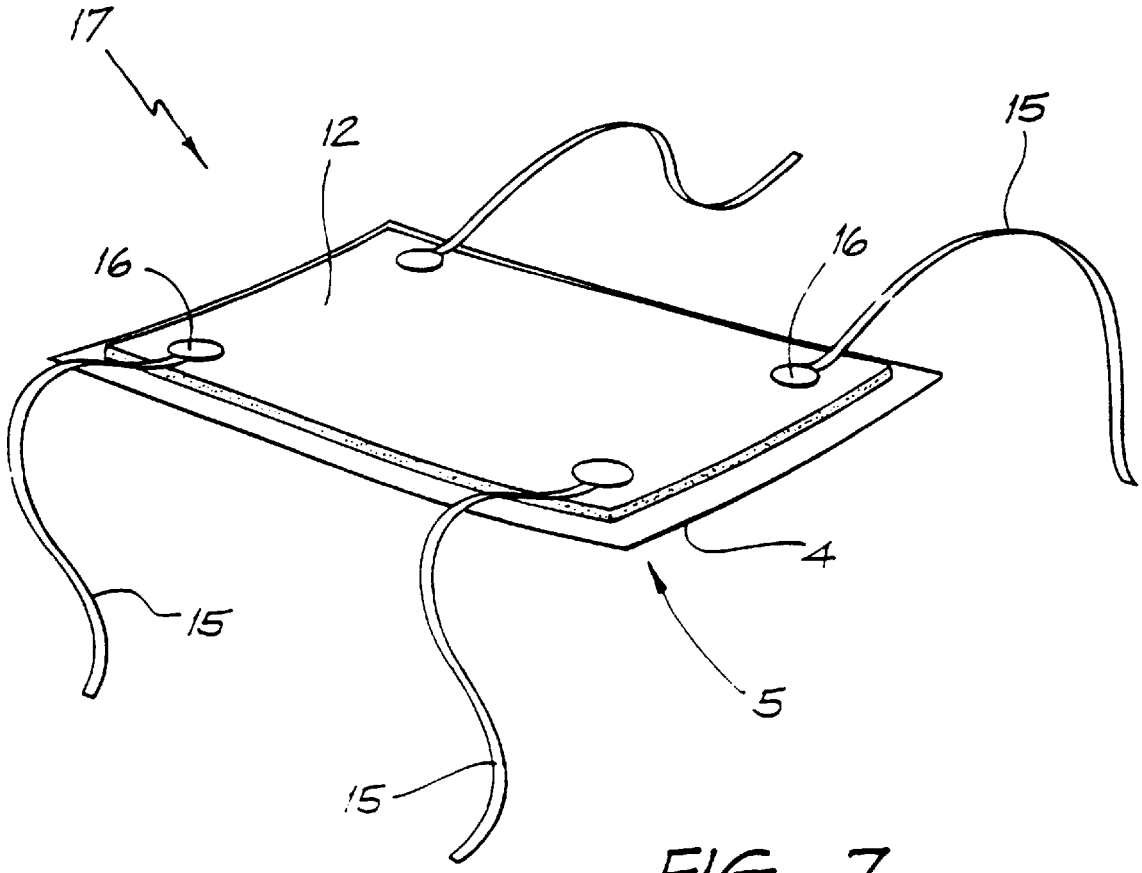
FIG. 7 is a perspective view of part of another embodiment of the pillow or cushion cover of this invention.

FIG. 7 shows part of a further embodiment of the cover somewhat similar to the embodiment shown in FIG. 5 and 6. Again, where applicable the same reference numerals have been used to indicate corresponding features. As for the previous embodiment a composite element 17 is formed by securing resilient layer 12 to facing layer 4 about their respective parameters. Four strings or tapes 15 are secured or seamed to the undersurface of resilient layer 4 or by means of adhesive stickers 16. In use, these tapes are passed around an envelope 2 similarly shown in FIG. 6 without the adhesive strip material 14. The strings are secured by tying the ends of adjacent pairs to hold the composite 17 to the envelope 2. This allows the composite to be replaced without the need to replace the envelope 2. Accordingly, the envelope 2 can be re-used a number of times until it is damaged or soiled.

In use, the disposable pillow or cushion cover according to this invention is used in the manner of a pillow case, and is replaced either when soiled or between users of the pillow or cushion.

The foregoing describes only one preferred embodiment of the invention and modifications can be made thereto without departing from the scope of the invention.

I claim:

1. A disposable pillow or cushion cover for use in covering a pillow or cushion to be used by an individual so as to protect the individual from receipt of contamination from a previous user, said disposable pillow or cushion cover comprising:

an inner envelope of air and moisture impermeable sheet material for encasing a pillow or cushion and providing a continuous, uninterrupted impermeable surface on one side of said envelope upon which a user may rest the head or other body part, vent means in said envelope for permitting ingress and egress of air from said pillow or cushion through said vent means, said vent means being located in a side of said envelope so as to direct egressing air away from said resting surface, and an outer facing layer of air permeable sheet material extending substantially over said one side of said envelope for supporting the head or other body part of the user, and being secured to said envelope at spaced apart locations in a coplanar, superimposed relationship over substantially entirely said one side of said envelope to allow air flow between said facing layer and said envelope and a degree of relative movement of said facing layer with respect to said envelope.

2. A cover as claimed in claim 1, wherein said facing layer is secured to the envelope by being secured about its perimeter.

3. A cover as claimed in claim 1, wherein the facing layer is releasably secured to the envelope by adhesive strips extending along at least two edges.

4. A cover as claimed in claim 1, wherein the facing layer is releasably secured to the envelope by ties able to be tied around the envelope.

5. A cover as claimed in claim 1, wherein a resilient layer is disposed between the facing layer and said envelope.

6. A cover as claimed in claim 5, wherein the resilient layer is secured to said envelope.

7. A cover as claimed in claim 5, wherein the resilient layer is secured to the facing layer.

8. A disposable pillow cover for use in covering a pillow to be used by a person so as to protect the person from receipt of contamination from a previous person using the same pillow, said disposable pillow cover comprising:

an inner envelope of air and moisture impermeable sheet material for totally encasing the pillow and providing a continuous, uninterrupted impermeable surface on one side of said envelope upon which a person may rest their head, an opening in said envelope permitting ingress and egress of air from within said envelope through said opening, said opening being located in a side of said envelope opposite to said resting surface so as to direct egressing air away from said resting surface and away from the person resting their head on the pillow, and an outer facing layer of air permeable sheet material extending substantially completely over said one side of said envelope for supporting the head or other body part of the user, said facing layer being secured to said envelope at spaced apart locations in a coplanar superimposed relationship over substantially entirely said one side of said envelope to allow air flow between said facing layer and said envelope and a degree of relative movement of said facing layer with respect to said envelope.

9. A disposable pillow cover for use in covering a pillow to be used by a person sleeping on the pillow so as to protect the person from receipt of contamination from a previous person using the same pillow, said disposable pillow cover comprising:

an inner envelope of air and moisture impermeable sheet material for totally encasing the pillow and providing a continuous, uninterrupted impermeable surface on one side of said envelope upon which a person may rest their head so as to isolate the person from the pillow, an opening in said envelope permitting ingress and egress of air from within said envelope through said opening, said opening being located in a side of said envelope so as to direct egressing air away from said resting surface and away from the person resting their head on the pillow so as to expel air in a direction away from the location of the head of the person, and an outer facing layer of air permeable sheet material extending substantially completely over said one side of said envelope for supporting the head or other body part of the user, said facing layer being secured to said envelope at spaced apart locations in a coplanar superimposed relationship over substantially entirely said one side of said envelope to allow air flow between said facing layer and said envelope and a degree of relative movement of said facing layer with respect to said envelope while the head of the person is protected by the impermeable sheet material of the envelope from any contamination that may have been transmitted to the pillow.

* * * * *